US008696961B2

(12) United States Patent
Edvardsson et al.

(10) Patent No.: US 8,696,961 B2
(45) Date of Patent: Apr. 15, 2014

(54) METHOD FOR FORMING AN ABSORBENT CORE

(75) Inventors: Gunnar Edvardsson, Bohus Björkö (SE); Ted Guidotti, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/132,383

(22) PCT Filed: Dec. 4, 2008

(86) PCT No.: PCT/SE2008/051404
§ 371 (c)(1),
(2), (4) Date: Jul. 22, 2011

(87) PCT Pub. No.: WO2010/064967
PCT Pub. Date: Jun. 10, 2010

(65) Prior Publication Data

US 2011/0281977 A1 Nov. 17, 2011

(51) Int. Cl.
*B29C 67/20* (2006.01)

(52) U.S. Cl.
USPC ..... 264/175; 524/13

(58) Field of Classification Search
USPC ..... 264/175; 524/13
See application file for complete search history.

(56) References Cited

U.S. PATENT DOCUMENTS

| | | | | |
|---|---|---|---|---|
| 5,389,168 | A * | 2/1995 | Litchholt et al. | 156/77 |
| 6,136,124 | A | 10/2000 | Wagner | |
| 6,455,129 | B1 | 9/2002 | Kershaw et al. | |
| 2004/0087923 | A1 | 5/2004 | Cole | |
| 2005/0045296 | A1 * | 3/2005 | Adam et al. | 162/157.6 |
| 2005/0148263 | A1 | 7/2005 | Zhou et al. | |
| 2006/0053593 | A1 * | 3/2006 | Gombash, Jr. | 19/66 T |

FOREIGN PATENT DOCUMENTS

| | | |
|---|---|---|
| EP | 1 253 231 | 10/2002 |
| JP | H06-205805 | 7/1994 |
| JP | H08-098859 | 4/1996 |
| JP | 2008-284182 | 11/2008 |

OTHER PUBLICATIONS

Japanese Office Action in corresponding Japanese patent application No. 2011-539471 dated Dec. 18, 2012 (5 pages).

* cited by examiner

*Primary Examiner* — Jacob Thomas Minskey
(74) *Attorney, Agent, or Firm* — Drinker Biddle & Reath LLP

(57) ABSTRACT

A method for forming an absorbent core. The method includes the steps of forming and compressing an absorbent core, followed by passing the absorbent core through a subsequent nip between two rolls. At least one of the rolls has a surface including an elastic material, such that the hard-spot number of the absorbent core is reduced. Also, a device for forming absorbent cores as well as absorbent cores produced using the method.

22 Claims, 1 Drawing Sheet

METHOD FOR FORMING AN ABSORBENT CORE

CROSS-REFERENCE TO PRIOR APPLICATION

This application is a §371 National Stage Application of PCT International Application No. PCT/SE2008/051253 filed Nov. 3, 2008.

FIELD OF THE INVENTION

The present disclosure relates to a method for forming an absorbent core. The disclosure also relates to a device for forming absorbent cores as well as an absorbent core produced using this method.

BACKGROUND

Absorbent cores are used in absorbent products, such as baby diapers, incontinence products and sanitary towels. Commonly, such absorbent cores include cellulosic fibers and/or superabsorbents. The absorbent cores can be formed individually or they can be formed as a web, which afterwards is divided into individual absorbent cores.

A typical production line includes one or more mat-formers, which form an absorbent material, being in the form of individual products or as a web, by air-lying. EP 1,253,231A2 discloses a method for forming a fiber web by means of air-lying fibers via a number of mat-formers, but a production line could also be run with only one mat-former.

There is a constant desire to run production lines for absorbent cores faster, in order to speed up the production. However, when running faster, the material formed in the mat-forming step tends to become more uneven, i.e. the variation in weight per unit area increases.

There is also a trend to make thin products, since these will take up less space and thereby be cheaper to package, transport and store, as well as being more convenient for the user. Therefore, it is common to compress the absorbent material between compression rolls to reduce its thickness.

However, it has been noticed that, when compressing a somewhat uneven material to relatively highly reduced thickness, so called hard-spots might appear. Hard spots may be described as local regions in the core being more compact and stiffer than the overall core. It is believed that the hard-spots form from the compression of regions having higher basis weight than the surrounding regions after the mat-forming step. Hence, hard-spots may appear in particular when using relatively high production speeds and for relatively thin absorbent cores.

Hard-spots can be felt by a user of the absorbent product both before use (e.g. by touching the products by hand) and in use. Being relatively stiff, the hard-spots may be perceived by a user as causing a less comfortable and less efficient product. This is particularly the case for larger hard-spots. Hence, it is desirable to avoid hard-spots as far as possible.

There is therefore a need for an improved method for forming an absorbent core.

SUMMARY

It is desired to provide an improved method for forming an absorbent core. This can be achieved by providing a method as disclosed below.

In a first aspect, the method includes the steps of forming an absorbent core and compressing it in a compression nip. Moreover, the method includes a subsequent step of passing the compressed absorbent core through a subsequent nip between two rolls, wherein at least one of the rolls has a surface including an elastic material, such that the hard-spot number of the absorbent core is reduced.

Surprisingly, it has been found that the hard-spot number of the absorbent core is reduced when comparing the hard-spot number before and after the subsequent nip. It may even be possible get rid of substantially all hard-spots. Not being bound by any theories, it is believed that the hard-spot number reducing effect which is achieved when the absorbent core passes through the subsequent nip works by breaking up network structures formed in the hard-spots. As such, the hard-spots that appear after the compression step may be described as semi-rigid networks of material components, e.g. cellulose fibers and superabsorbents. The networks are formed during the compression and are rigid enough to withstand ordinary handling of the material, but when the absorbent material is run through the subsequent nip, the force applied partly breaks these rigid networks up. When a large network perceived as a hard-spot is broken up into a number of smaller networks, small enough not to be noticed by a user, the hard-spot is deemed to be removed.

It has been found that the proposed method has the advantage of providing a possibility to run the production at high speeds and with compression of the absorbent cores to the desired thickness, while reducing the hard-spot number.

In particular embodiments, passing the absorbent core through the subsequent nip is a separate processing step. In certain embodiments, the processing steps of the method follow immediately after each other. However, other processing steps could be placed in between the steps of the method, as long as they do not interfere with the intended function of reducing the hard-spot number.

After the subsequent nip, the hard-spot number of the absorbent core may be less than 50% of the hard spot number before the subsequent nip, preferably less than 30%, and most preferably less than 10%. Indeed, in many cases, and most preferred, there are substantially no hard-spots at all after the subsequent nip. As explained above, a low hard-spot number is preferred, since the hard-spots may be perceived as disturbing by the user.

In the compression nip, the thickness of the absorbent core may be reduced by more than 40%, preferably more than 50% and most preferably more than 60%. A thin absorbent core makes it possible to produce a thin absorbent article, which often is preferred for reasons such as saving space and giving the user a higher comfort.

After the subsequent nip the density of the absorbent core may be 70-120% of the density before the subsequent nip, preferably 80-115%, and most preferably 90-110%. Hence, the subsequent nip does not have much influence on the overall density of the core; instead its primary task is to reduce the hard-spot number.

The hard-spot number after the compression step is generally higher at high speeds for the production line. The method is thus particularly useful when the transport speed of the absorbent core through the nips is more than 200 m/min. With such high speeds, conventional lines may result in products having hard-spot problems. Contrary to conventional methods, the disclosed method results in cores having a relatively low hard-spot number also at those high speeds.

The absorbent core advantageously includes cellulosic pulp fibers and/or superabsorbents. The amount of superabsorbents may be up to 80% of the total weight of the absorbent core, preferably up to 60% and most preferably up to 50%. The amount of superabsorbents may be 50-70% or 30-50%. Sometimes, a high amount of superabsorbents is desired to get enough absorption for a certain product weight. With the disclosed method, also cores with a high superabsorbent content may be produced without displaying hard-spot problems. In one embodiment, the absorbent core may include cellulosic pulp fibres and superabsorbents.

A carrier material may be placed on a first and/or second face side of the absorbent core. Thereby, the risk of the absorbent material getting stuck to the roll surfaces in the nips is reduced, since the carrier material will be located between the roll surface and the absorbent core.

Either only one or both of the rolls of the subsequent nip have surfaces including an elastic material. The elastic material may have a hardness of 40-90 Shore A, preferably 50-85 Shore A, and most preferably 60-80 Shore A. The material may be the same on both rolls of the subsequent nip or different. A suitable elastic material may be rubber. By varying the material, it is possible to adapt the subsequent nip, so that the desired product characteristics can be achieved.

In an embodiment, the rolls of the subsequent nip have flat surfaces. Thereby, the pressure in the nip may be uniformly distributed and the hard-spot number reducing effect takes place over the whole surface of the nip.

The compression rolls may have non-elastic surfaces. For example, the compression rolls may have metallic surfaces, providing a durable surface material.

In a second aspect, a device for forming absorbent cores is provided. The device includes:

a mat-former for forming absorbent cores;

a compression nip between two compression rolls;

a subsequent nip between two rolls, the subsequent nip being downstream of the compression nip; wherein at least one of the rolls of the subsequent nip has a surface including an elastic material. Such a device is adapted to produce absorbent cores according to the above-mentioned method.

In a third aspect, an absorbent core made with the method described above is provided. In an embodiment, the absorbent core has a pulp bulk of less than 10 g/cm$^3$, preferably less than 8 g/cm$^3$ and most preferably less than 6 g/cm$^3$ and substantially no hard-spots.

BRIEF DESCRIPTION OF THE DRAWINGS

Embodiments of the present invention will hereinafter be explained in greater detail by means of non-limiting examples and with reference to the appended drawings in which.

DETAILED DESCRIPTION OF PREFERRED EMBODIMENTS

In the following, embodiments of the invention will be exemplified. It is to be understood, however, that the embodiments are included in order to explain principles of the invention and not to limit the scope of the invention, defined by the appended claims.

Figure 1:
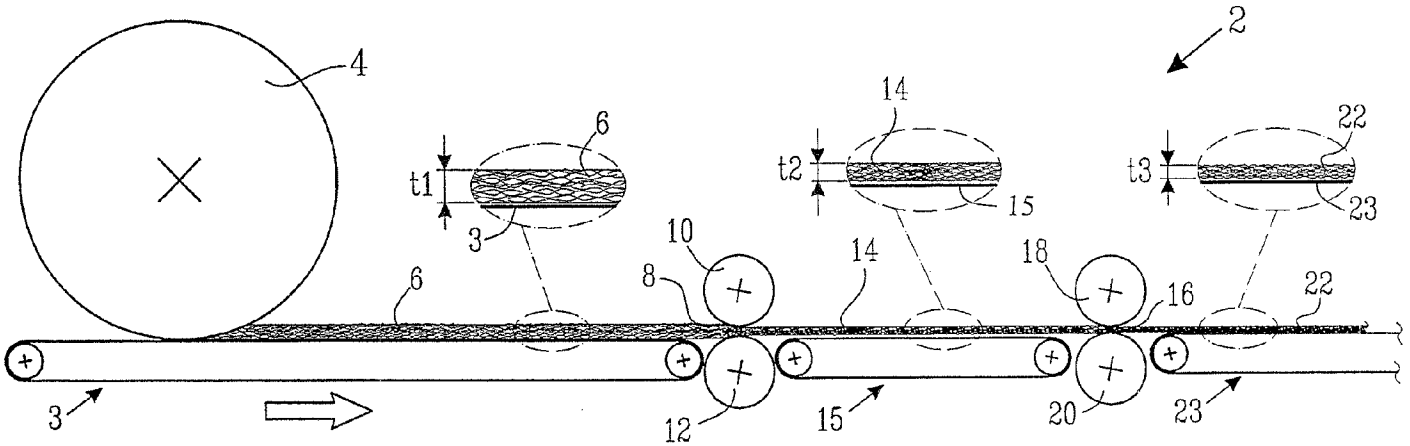
FIG. 1 is a schematic side view of a section of a production line.

FIG. 1 is a schematic drawing of a section 2 of an example of a production line performing an embodiment of the method proposed herein. In this embodiment, absorbent cores are formed on a belt 3 from fibers by the mat-former 4, using means of air-lying. The absorbent cores could be formed as individual articles one after the other or in the form of a continuous web, which is divided into individual articles in a later step. The absorbent material 6 leaving the mat-former has a certain thickness t1. After the mat-former the absorbent material 6 is conveyed to a compression nip 8 between two compression rolls 10, 12. The absorbent material is compressed in the compression nip 8 in order to decrease its thickness. The thickness after the mat-former t1 could thus be reduced by 40%, preferably 50% and most preferably 60% in relation to t2, the thickness after the compression nip 8. If there are any local regions in the absorbent material 6 formed by the mat-former having higher basis weight than the surrounding regions, these local regions may appear as hard-spots in the compressed material 14 after the compression nip 8.

The absorbent material is thereafter conveyed by a subsequent belt 15 to a subsequent nip 16 between two rolls 18, 20. At least one of the rolls 18, 20 includes a surface of elastic material. The subsequent nip 16 may be used for further compression, making the material a little thinner, giving the further compressed material 22 the thickness t3 after the subsequent nip 16. The primary purpose of the subsequent nip 16 is however to make the material softer by getting rid of the hard-spots. After the subsequent nip 16 the absorbent material is further conveyed by an additional belt 23.

The compression nip may include one, two, three or more compression nips, which gradually reduce the thickness of the absorbent core. The subsequent nip may also include one, two, three or more nips. However, in many embodiments it is preferred to use as few nips as possible. In particular embodiments, one nip for compression and one nip for the subsequent nip are used.

In FIG. 1 the compression nip 8 and the subsequent nip 12 are shown as separate units. It would also be possible to combine them in one unit, where a central roll is used as a counter roll both for the compression nip and for the subsequent nip. In that case, the central roll may preferably have a metallic surface. In most embodiments, a separate compression nip followed by a separate subsequent nip is utilized, since then the materials of the rolls in the two nips can be optimized for their different purposes. As an example, metallic surfaces like steel are good for the compression nip, since these rolls are durable, while at least one of the rolls in the subsequent nip has an elastic surface.

Generally the problems with hard-spots increase, when the speed of the production line is increased, at least because the absorbent material formed on the mat-former may then be less uniform. The uniformity of the material can be measured as CV, i.e. coefficient of variation, for the weight per unit area, also called basis weight.

CV—Variation in Weight Per Unit Area

A suitable method for determining CV, the coefficient of variation for weight per unit area, on an absorbent material is described below:

1. Samples with an area of 1365 mm$^2$ are stamped out of the fiber web or the absorption body to be investigated. Samples are taken from different parts of an absorption core, for example the front, the rear, the right side, the left side and the center, within areas with the same weight per unit area.
2. Measurement is carried out on randomly selected products numbering at least 15, suitably 50.
3. The samples are weighed and standard deviation S and mean $\overline{X}$ are calculated. The coefficient of variation CV in percent is then obtained from:

$$CV = \frac{S}{\overline{X}} 100$$

4. If it is desired to see the variation in the side or the front/rear, the samples have to be kept in order. This is suitable in order for it to be possible, if necessary, to establish whether there may be a variation of the right/left type.

Pulp Bulk

Pulp bulk is defined as the bulk of the pulp $B_{pulp}$ in $cm^3/g$, which is calculated as volume occupied by pulp, in $cm^3$, excluding the volume that is occupied by superabsorbents, divided by the weight of the pulp, in g.

$$B_{pulp} = \frac{t - (bw_{SAP} / \rho_{SAP})}{bw_{pulp}}$$

t=sample thickness, in cm.

bw=basis weight, in $g/cm^2$ $\rho_{SAP}$: Bulk density of superabsorbent according to Edana WSP 260.2 (05), in $g/cm^3$.

Indices pulp and SAP refers to the respective materials, pulp and superabsorbents.

Bulk is the reverse of density: $B=1/\rho$.

If there are other material components in the absorbent material, these have to be subtracted as well. Thickness was measured with a circular pressure head having a diameter of 80 mm. Pressure was 0.5 kPa. Values were recorded after 5 s contact time.

Pulp bulk is a theoretical value which is used as a way to compare different absorption cores having different SUPERABSORBENT concentrations. For these it would be misleading to use total density, or total bulk, and pulp bulk is one way to compensate for this.

As a rule of thumb, hard-spots problems normally occur in conventional production lines when CV is larger than about 8% to 10% for highly compressed products. The pulp bulk level where hard spots begin to show up depends on many factors, for example the raw materials used in the absorbent core and the concentration of SUPERABSORBENT. Typically, hard spots begin somewhere around pulp bulk 8-10 $cm^3/g$, but may not start up until pulp bulk 5 $cm^3/g$.

As mentioned above, the hard-spot problem may in general get worse when the production speed is increased, since the material from the mat-former then may be more uneven. On the other hand, a high speed is wanted for increased productivity. The hard-spot problem may also increase the more compressed the absorbent material is. However, high compression is desired to get thin products. Also, it is believed that high humidity is another factor that contributes to the hard-spot problem, but, on the other hand, a certain humidity is desired, for example, to avoid problems with static electricity. Also, the hard-spot problem may get worse with a high amount of superabsorbents, especially if the superabsorbents are unevenly distributed in the absorbent core.

In view of the above, it is understood that the method proposed herein provides a measure for diminishing the problem with hard-spots (i.e. diminishing the hard-spot number), without having to compromise with other factors being potentially relevant for the formation of hard-spots. Indeed, the proposed method suggests removing the hard-spots after they are formed rather than inhibiting the formation of hard-spots.

Figure 2:
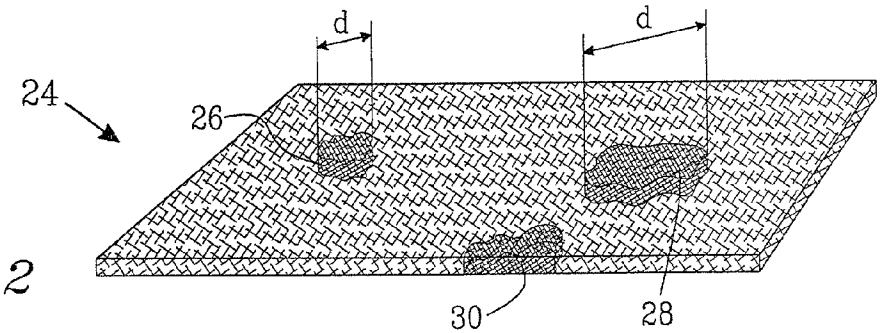
Prior Art Fig.2
FIG. 2 is a schematic view of an absorbent core according to prior art.

FIG. 2 illustrates schematically an absorbent core 24 made with conventional methods. With reference to FIG. 1, a conventional method would be similar to removing the absorbent core directly after the compression nip 8 (and before the subsequent nip 16). In such an absorbent core, as illustrated in FIG. 2, a number of hard-spots 26, 28, 30 may be present.

As previously mentioned, a hard-spot may be defined as a region of the absorbent core having a local density higher than the average density of the absorbent core. A hard-spot goes all the way through the absorbent core and can be felt from both face sides of the absorbent core as a compact region. It may also be noticed that the bending stiffness of the hard-spot is higher than that of the surrounding material.

Hard-spots can be perceived by a user of the absorbent product before use and possibly in use. Sometimes, just one hard-spot in a core may cause the user to deem the product to be of lesser quality, if the hard-spot is at an unfortunate location and/or of a larger size.

Hard-spots could have any size, having a maximum diameter from just a few millimeters to a couple of centimeters. They often have an irregular shape. However, really small hard spots are hardly noticed, and a diameter of 4 mm represents a practical lower limit for when they become disturbing for the user. Accordingly, for this application, any hard spots having a maximum diameter less than 4 mm are disregarded (i.e. not deemed to be a hard spot at all).

Hard-Spot Number

In order to quantify the amount, the amount of hard-spots is referred to as a "hard-spot number". For determining the hard-spot number, a person feels over the absorbent core with his/her hands, e.g. by using the thumb on one side and the other fingers on the other side. The hard-spots can easily be felt as a relatively compact region, i.e. being more compact than the surrounding regions, and extending all the way through the core. When a hard-spot is noticed, it is marked by drawing a line around its contour on one of the face sides of the absorbent core. When all possible hard-spots in a certain absorbent core have been detected, each hard-spot is checked to determine its maximum diameter d. The maximum diameter d is the longest straight line that can be drawn from one point on the contour to another point on the contour of a certain hard-spot. See examples in FIG. 2. The hard-spot number is the number of hard-spots having a maximum diameter d larger than 4 mm expressed per area unit. If a particular hard-spot is found to have a maximum diameter d less than 4 mm, it is disregarded when calculating the hard-spot number. The hard spot-number may be expressed as number of hard-spots per $m^2$. For diapers, the hard spot number is often given as number of hard spots per 40 products, since 40 products make up a normal package.

With conventional production methods, there may be individual absorbent cores without hard-spots, but every now and then, absorbent cores with hard-spots may appear. When reasoning about reducing hard-spot numbers, regard is taken to a number of cores, and not just to the individual absorbent cores, which arbitrarily may not have any hard-spots, even with conventional production methods.

The fibers used for the absorbent cores can be different types or fibers or mixtures thereof, such as mechanical, thermomechanical, chemi-thermomechanical or chemical pulp fibers. Mixtures containing synthetic fibers and highly absorbent fibers are also possible.

Suitable superabsorbents include both traditional superabsorbents and bio-superabsorbents based partially or completely on renewable or sustainable raw materials. Organic materials suitable for use as superabsorbent materials include natural materials such as polysaccharides, polypeptides and the like, as well as synthetic materials such as synthetic hydrogel polymers. Such hydrogel polymers include, for example, alkali metal salts of polyacrylic acids, polyacrylamides, polyvinyl alcohol, polyacrylates, polyacrylamides, polyvinyl pyridines, and the like. Other suitable polymers include hydrolyzed acrylonitrile grafted starch, acrylic acid grafted starch, and isobutylene maleic anhydride copolymers and mixtures thereof. The hydrogel polymers can preferably be lightly crosslinked to render the material substantially water insoluble. Particular superabsorbent materials are further surface crosslinked so that the outer surface or shell of the superabsorbent particle, fiber, flake, sphere, etc. possesses a higher crosslink density than the inner portion of the superabsorbent. The superabsorbent materials may be in any form suitable for use in absorbent composites including particles, fibers, flakes, spheres, and the like.

In the embodiment illustrated in FIG. 1, the absorbent material 6 is fainted on a belt 3 without the use of carrier materials. In an alternative embodiment, the absorbent material may be formed on top of a carrier material. It would also be possible to place a carrier material on a first and/or second face side of the absorbent material after mat-forming. By letting the carrier materials be fed through the compression nip and subsequent nip together with the absorbent material, the risk of the absorbent material getting stuck to the rolls is reduced. Suitable carrier materials are, for example, tissue or nonwoven materials. If a carrier material is used, one or more of the belts 3, 15, 23 may be omitted.

The rolls 10, 12 used in the compression nip 8 may be of the conventional type used for compression of absorbent materials. Suitable materials for the roll surface are steel or tempered steel. At least one of the rolls 18, 20 of the subsequent nip 16 should have an elastic surface. Suitable materials are, for example, rubber, nitrile rubber and polyurethane. The surfaces of the rolls 18, 20 of the subsequent nip 16 can be preferably substantially flat. The surface thus does not have any pattern which could give an embossing effect; instead it is the above-mentioned network break-up effect which is desired.

When producing an absorbent core with the method, the nips have to be set. Nip pressures are commonly measured as line load or gap width. The compression nip is adjusted to reach the desired compression level. This adjustment is similar to what is made in a conventional production line, so the adjustment procedure is well-known to the man skilled in the art.

When adjusting the subsequent nip, regard should be taken to adjust it so that the density of the absorbent core is practically the same or only slightly increased, for example by 0-10%. A suitable adjustment procedure may start with an open nip and gradually decrease the gap until the desired hard-spot number reduction effect is reached. At first the decrease of the gap could be made in large steps, while keeping an eye on t3, the thickness after the subsequent nip, in relation to t2, the thickness after the compression nip. As soon as t3 gets lower than t2, the decrease of the gap width should be done in small steps. By way of precaution, it is advisable to take a few small steps backwards, increasing the gap a little again, and then continue decreasing the gap width with these small steps. Since at least one of the rolls has an elastic surface, the gap width of the subsequent nip will be less than for the compression nip including rolls with metallic surfaces. Sometimes the gap width may even be negative, since the elastic surface deforms locally.

In particular embodiments, the adjustments are made for each type of absorbent core. For example, when increasing the basis weight or the relative amount of superabsorbent, new adjustments may be done. Other parameters influencing the adjustment of the subsequent nips are for example type of fiber, type of superabsorbent, presence of other material components, presence of carrier materials, relative humidity of ingoing materials and of the air, amount of compression made in the compression step, type of mat-former and how evenly it can distribute the material components, diameter of rolls, material of rolls, wear compensation for rolls, speed of production line and desired product properties.

EXAMPLE 1

A number of absorbent products were produced on a production line having a one-step mat-former, a one-nip compression and a one-nip subsequent nip. After the subsequent nip, there were no hard-spots having a diameter over 4 mm.

Thickness of complete product: 5.2 mm.
Thickness of absorbent core, t3: 4.2 mm (product thickness reduced by face materials, that is the thickness after the subsequent nip).
Thickness after compression step, t2: 5 mm
Thickness after mat-former, t1: 12 mm
Line speed: 600 pieces/min
Basis weight pulp: 400 g/m$^2$ (Weyerhouser CF 416, 9% moisture)
Basis weight superabsorbent: 320 g/m$^2$ (B-7160 BASF)
Compression nip: 1.55 mm gap
Subsequent nip: 0.2 mm gap
Rolls subsequent nip: ϕ 200 mm, Materials: Roll 1: 10 mm 70 Shore A, polyurethane on a steel core; Roll 2: Steel Comparative tests using the same mat-former and compression unit but omitting the subsequent nip showed that at the same thickness, t2=5 mm, hard-spots were present. (Since there was no subsequent nip, t3=t2). Hence it was clear, that the effect of the subsequent step was to remove the hard-spots from the compressed absorbent core.

EXAMPLE 2

Both rolls of the subsequent nip had a silicone surface 70 Shore A, 20 mm silicone on a steel core, ϕ 200 mm. Gap width, was −2 mm. (Negative gap widths are possible because of the elastic surface materials.) All other parameters were identical to Example 1. The products were as good as in Example 1 including no hard-spots, but the rolls of the subsequent nips were worn out quicker than the rolls in Example 1.

The invention has been described above by way of example only and the skilled person will appreciate that many modifications of the above-described embodiments are conceivable within the scope of the appended claims.

Examples of such modifications are different nip pressures, amount of nips, diameter of rolls, location in the production line, material of rolls, wear compensation for rolls, speed of production line, presence of carrier materials or not, amount of compression made in the compression step, type of mat-former and how evenly it can distribute the material components.

The invention claimed is:

1. A method for forming an absorbent core comprising the steps of:

forming an uncompressed absorbent core;

compressing said uncompressed absorbent core in at least one compression nip to form a compressed absorbent core; and passing said compressed absorbent core with no substantial amount of uncompressed absorbent material through at least one subsequent nip to form said absorbent core, wherein the at least one subsequent nip comprises two rolls, wherein at least one of said rolls has a surface comprising an elastic material, and wherein the at least one subsequent nip is set so that the density of said absorbent core is 70-120% of the density of said compressed absorbent core, and the hard-spot number of said absorbent core is less than the hard-spot number of said compressed absorbent, wherein said absorbent core comprises at least one of cellulosic pulp fibers and superabsorbents.

2. The method according to claim 1, wherein passing said compressed absorbent core through said subsequent nip is a separate processing step.

3. The method according to claim 1, wherein the hard-spot number of said absorbent core is less than 50% of the hard-spot number of said compressed absorbent core.

4. The method according to claim 3, wherein the hard-spot number of said absorbent core is less than 30% of the hard-spot number of said compressed absorbent core.

5. The method according to claim 4, wherein the hard spot number of said absorbent core is less than 10% of the hard-spot number of said compressed absorbent core.

6. The method according to claim 1, wherein said absorbent core has substantially no hard-spots.

7. The method according to claim 1, wherein the thickness of said compressed absorbent core is more than 40% less than the thickness of said uncompressed absorbent core.

8. The method according to claim 7, wherein the thickness of said compressed absorbent core is more than 50% less than the thickness of said uncompressed absorbent core.

9. The method according to claim 8, wherein the thickness of said compressed absorbent core is more than 60% less than the thickness of said uncompressed absorbent core.

10. The method according to claim 1, wherein the amount of superabsorbents is up to 80% of the total weight of the absorbent core.

11. The method according to claim 10, wherein the amount of superabsorbents is up to 60% of the total weight of the absorbent core.

12. The method according to claim 11, wherein the amount of superabsorbents is up to 50% of the total weight of the absorbent core.

13. The method according to claim 1, wherein the amount of superabsorbents is 30-70% of the total weight of the absorbent core.

14. The method according to claim 1, wherein the method further comprises the step of placing a carrier material on at least one of a first or second face side of said absorbent core.

15. The method according to claim 1, wherein both of said two rolls of said at least one subsequent nip have surfaces comprising an elastic material.

16. The method according to claim 1, wherein said elastic material has a hardness of 40-90 Shore A.

17. The method according to claim 16, wherein said elastic material has a hardness of 50-85 Shore A.

18. The method according to claim 17, wherein said elastic material has a hardness of 60-80 Shore A.

19. The method according to claim 1, wherein said rolls of said at least one subsequent nip have flat surfaces.

20. The method according to claim 1, wherein said at least one compression nip comprises two compression rolls having metallic surfaces.

21. The method according to claim 1, wherein the density of said absorbent core is 80-115% of the density of said compressed absorbent core.

22. The method according to claim 21, wherein the density of said absorbent core is 90-110% of the density of said compressed absorbent core.

* * * * *